US010791813B2

(12) United States Patent
Senbo et al.

(10) Patent No.: US 10,791,813 B2
(45) **Date of Patent: *Oct. 6, 2020**

(54) AUTOMATIC HAIR WASHING DEVICE

(71) Applicant: SERIX CO., LTD., Kita-gun, Kagawa (JP)

(72) Inventors: Hisao Senbo, Kagawa (JP); Yuichiro Chujo, Kagawa (JP); Keizo Yamamoto, Kagawa (JP)

(73) Assignee: SERIX CO., LTD., Kita-gun, Kagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/272,648

(22) Filed: Feb. 11, 2019

(65) Prior Publication Data

US 2019/0166968 A1 Jun. 6, 2019

Related U.S. Application Data

(63) Continuation of application No. 15/750,437, filed as application No. PCT/JP2016/088791 on Dec. 26, 2016, now Pat. No. 10,238,198.

(30) Foreign Application Priority Data

Dec. 29, 2015 (JP) ..... 2015-257598

(51) Int. Cl.
*A45D 19/14* (2006.01)
*A45D 19/00* (2006.01)
(Continued)

(52) U.S. Cl.
CPC ..... *A45D 19/14* (2013.01); *A45D 19/00* (2013.01); *A45D 19/06* (2013.01); *A45D 19/10* (2013.01);
(Continued)

(58) Field of Classification Search
CPC ..... A45D 19/14
(Continued)

(56) References Cited

U.S. PATENT DOCUMENTS 2,856,918 A 10/1958 Kingery et al.
4,769,861 A 9/1988 Chang
(Continued)

FOREIGN PATENT DOCUMENTS

JP S61-100302 U 6/1986
JP H06-022812 A 2/1994
(Continued)

OTHER PUBLICATIONS

International Search Report of PCT/JP2016/088791(disclosed in the parent app No. 15750437 with the IDS dated Feb. 5, 2018 therefore no reference is submitted herein).

*Primary Examiner* — Lori L Baker
(74) *Attorney, Agent, or Firm* — Muncy, Geissler, Olds & Lowe, P.C.

(57) ABSTRACT

An automatic hair washing device includes a washing part including a cover member having a head holding space, a plurality of contacts each of which is formed of a rod-shaped member, and energization means for energizing the contacts to move toward the head holding space, wherein the energization means includes an accommodation space where a fluid is accommodated and a fluid pressure adjustment part to adjust a pressure of the fluid accommodated in the accommodation space at a predetermined level, and the fluid pressure adjustment part is configured to adjust the pressure of the fluid accommodated in the accommodation space at a pressure to energize the contacts toward the head holding space such that the contacts are in contact with the human head apply approximately constant forces to the human head even when the contacts are moved by the human head.

15 Claims, 6 Drawing Sheets

(51) Int. Cl.

| | |
|---|---|
| ***A45D 19/06*** | (2006.01) |
| ***A61H 33/00*** | (2006.01) |
| ***A45D 19/10*** | (2006.01) |
| ***A61H 35/00*** | (2006.01) |
| ***A61H 7/00*** | (2006.01) |

(52) U.S. Cl.
CPC ..... *A61H 33/00* (2013.01); *A61H 35/008* (2013.01); *A61H 7/007* (2013.01); *A61H 2205/021* (2013.01)

(58) Field of Classification Search
USPC ..... 4/515–523; 132/200
See application file for complete search history.

(56) References Cited

U.S. PATENT DOCUMENTS

| | | | |
|---|---|---|---|
| 5,014,371 | A | 5/1991 | Heel |
| 5,025,514 | A | 6/1991 | Miller |
| 5,075,908 | A | 12/1991 | Newman |
| 5,528,776 | A | 6/1996 | Carmichael |
| 5,906,012 | A | 5/1999 | Sakane et al. |
| 6,205,596 | B1 | 3/2001 | Shimizu |
| 6,205,597 | B1 | 3/2001 | Shimizu |
| 6,249,922 | B1 | 6/2001 | Shimizu |
| 6,401,272 | B2 | 6/2002 | Shimizu et al. |
| 7,171,704 | B2 | 2/2007 | Johnson |
| 2001/0054197 | A1 | 12/2001 | Shimizu |
| 2013/0145540 | A1 | 6/2013 | Mizuno et al. |
| 2014/0238429 | A1 | 8/2014 | Mizuno et al. |
| 2014/0373265 | A1 | 12/2014 | Fujioka et al. |
| 2014/0373266 | A1 | 12/2014 | Fujioka et al. |

FOREIGN PATENT DOCUMENTS

| | | | |
|---|---|---|---|
| JP | H06-113918 | A | 4/1994 |
| JP | 2001-149133 | A | 6/2001 |
| WO | 2012/023278 | A1 | 2/2012 |
| WO | 2013/051224 | A1 | 4/2013 |

AUTOMATIC HAIR WASHING DEVICE

CROSS REFERENCE TO RELATED APPLICATIONS

This application is a Continuation Application of the U.S. application Ser. No. 15/750,437 filed Feb. 5, 2018, which is a national stage of International Application No.: PCT/JP2016/088791, which was filed on Dec. 26, 2016, and which claims priority to JP 2015-257598 which was filed on Dec. 29, 2015, and which are both herein incorporated by reference.

TECHNICAL FIELD

The present invention relates to an automatic hair washing device.

BACKGROUND ART

In barber shops, hair salons, caregiving homes, hospitals, and other facilities, heretofore, an employee often washes the hair of a person whose hair is to be washed, such as a customer or a person who needs care. In such a case, the employee rests the head of a person whose hair is to be washed, on a washbasin with his/her face up or down, wets the hair with a shower running, and puts a detergent such as a shampoo on the hair, thereby washing the hair. The hair washing produces an effect of massaging a scalp since the scalp is scrubbed by human fingers in addition to hair. Therefore, the hair washing makes a person whose hair is to be washed feel comfortable.

The hair washing involves many processes such as wetting hair, washing the hair with a shampoo, rinsing the shampoo from the hair, and drying the hair, and therefore requires times and efforts to some extent. In addition, the employee washes the hair of a person whose hair is to be washed so as not to make him/her feel uncomfortable, and such a situation becomes a large burden on the employee. For this reason, devices to achieve an automatic hair washing operation have been required in not only caregiving homes and hospitals, but also barber shops and hair salons.

For example, Patent Documents 1 and 2 each disclose a device configured to spray cold or hot water and a detergent onto a scalp and hair through nozzles, thereby washing the hair. Such a device enables a certain degree of hair washing operation by moving the nozzles for spraying water and adjusting a pressure and amount of water to be sprayed.

However, this device merely sprays liquids onto a human head, and therefore the hair washing operation by this device is significantly difficult from hair washing by human hand in terms of a sensation on, for example, a scalp. Consequently, a person whose hair is to be washed does not feel comfortable unlike the hair washing by human hand. In other words, the hair washing operation by this device occasionally makes the person feel unpleasant.

It is considered that appropriate stimulation of a scalp by physical contact like contact of human fingers with a scalp becomes necessitated in order to approach hair washing by human hand.

Patent Documents 3 to 6 each disclose a device configured to stimulate a scalp by physical contact with the scalp.

Specifically, Patent Documents 3 to 5 each disclose a device including a protruding member to come into contact with a scalp and to scrub the scalp.

Patent Document 6 discloses a device including a rod-shaped member, like a human finger, to be pressed against a scalp by a spring. According to this device, the rod-shaped member has a leading end configured to come into contact with the scalp and to scrub the scalp.

PRIOR ART DOCUMENTS

Patent Documents

Patent Document 1: JP H06-113918 A
Patent Document 2: JP H06-022812 A
Patent Document 3: JP S61-100302 U
Patent Document 4: WO 2012/023278 A1
Patent Document 5: WO 2013/051224 A1
Patent Document 6: JP 2001-149133 A

SUMMARY OF THE INVENTION

Problems to be Solved by the Invention

According to the technique disclosed in Patent Document 3, a protrusion is merely provided on a surface of a bag-shaped member. It is therefore possible to bring the protrusion into contact with a scalp in such a manner that the surface of the bag becomes deformable in accordance with the shape of a head; however, it is difficult to bring the protrusion into contact with the scalp by an appropriate force.

According to the techniques disclosed in Patent Documents 4 and 5, a sensor is provided for measuring a contact pressure, and a force to press a protrusion against a scalp is adjusted based on a result of the measurement. Therefore, the protrusion can be brought into contact with the scalp by an appropriate force. However, since there are various shapes of human heads, a large number of sensors and a mechanism of adjusting forces to press protrusions against a scalp are required for bringing each protrusion into contact with the scalp by an appropriate force. This makes a device structure considerably complicated. Even when the forces to bring the protrusions into contact with the scalp are adjustable, since each of the protrusions is formed in a spherical shape and a contact state of the protrusions with the scalp is significantly different from a contact state of human fingers with the scalp, the techniques disclosed in Patent Documents 4 and 5 are incapable of achieving a comfortable sensation of hair washing by human hand. In washing hair by human fingers, the fingers stroke the hair to come into contact with a scalp, so that moving the fingers produces an effect of brushing the hair. On the other hand, the protrusions disclosed in Patent Documents 4 and 5 merely press hair against a scalp and are incapable of stroking the hair. Therefore, the techniques disclosed in Patent Documents 4 and 5 are incapable of producing an effect to be obtained in washing hair by human fingers.

According to the technique disclosed in Patent Document 6, the spring brings the rod-shaped member into contact with a scalp. Therefore, the technique disclosed in Patent Document 6 can achieve a hair washing operation like hair washing by human hand to some extent. According to the technique disclosed in Patent Document 6, however, the spring is merely provided to cause the movement of the rod-shaped member to follow the scalp, and no consideration is taken into account as to how a contact state of the rod-shaped member with the scalp is appropriately adjusted. In addition, Patent Document 6 has neither description nor suggestion as to how to make the contact state of the rod-shaped member with the scalp approach a sensation of hair washing by human hand.

As described above, automatic hair washing devices which have been currently developed are incapable of performing a hair washing operation like hair washing by human hand. Hence, it has been desired that an automatic hair washing device is developed to achieve a hair washing operation like hair washing by human hand.

In view of the circumstances described above, the present invention provides an automatic hair washing device configured to achieve a hair washing operation like hair washing by human hand.

Means for Solving the Problems

A first aspect of the invention provides an automatic hair washing device including a washing part including: a cover member having a head holding space where a human head is placed; a plurality of contacts each formed of a rod-shaped member and each disposed on an inner face of the cover member in an axially movable manner; and energization means for energizing the contacts toward the head holding space, wherein the washing part is disposed such that the cover member is movable along the human head, the energization means includes: an accommodation space where a fluid is retainable, the accommodation space being formed in a hollow shape and separated from the head holding space by an inner wall of the cover member; and a fluid pressure adjustment part to adjust a pressure of the fluid accommodated in the accommodation space at a predetermined level, the fluid accommodated in the accommodation space is a compressive fluid, and the fluid pressure adjustment part is configured to adjust the pressure of the fluid accommodated in the accommodation space at a pressure to energize the contacts toward the head holding space such that the contacts being in contact with the human head apply approximately constant forces to the human head even when the contacts are moved.

A second aspect of the invention provides the automatic hair washing device according to the first aspect of the invention, wherein the contacts are disposed such that axes thereof extend orthogonal to the inner face of the inner wall of the cover member.

A third aspect of the invention provides the automatic hair washing device according to the first or second aspect of the invention, wherein the accommodation space is divided into a plurality of spaces, and the fluid pressure adjustment part is configured to adjust pressures of fluids to be supplied to the respective spaces divided.

A fourth aspect of the invention provides the automatic hair washing device according to the first, second, or third aspect of the invention, further including a spring member to energize each contact toward the head holding space, wherein the spring member has an energizing force adjusted to be weaker than a force of the fluid supplied into the accommodation space, the force energizing the contacts toward the head holding space.

A fifth aspect of the invention provides the automatic hair washing device according to the first, second, or third aspect of the invention, further including a spring member to pull each contact toward the accommodation space.

A sixth aspect of the invention provides an automatic hair washing device including a washing part including: a cover member having a head holding space where a human head is placed; a plurality of contacts each formed of a rod-shaped member and each disposed on an inner face of the cover member in an axially movable manner; and energization means for energizing the contacts toward the head holding space, wherein the washing part is disposed such that the cover member is movable along the human head, each of the contacts is formed of a one end-closed tubular member having a closed end with which the human head is in contact, the one end-closed tubular member being formed in a hollow shape and disposed such that an axis thereof extends orthogonal to the inner face of an inner wall of the cover member, the energization means includes a spring member disposed inside each contact to energize the corresponding contact toward the head holding space, and the spring member is adjusted such that an energizing force to be applied to the corresponding contact when the contact protrudes in a minimum amount becomes approximately equal to an energizing force to be applied to the corresponding contact when the contact protrudes in a maximum amount.

A seventh aspect of the invention provides the automatic hair washing device according to any of the first to sixth aspects of the invention, wherein each of the contacts includes a contact portion with which the human head is in contact, the contact portion being configured to be detachable.

An eighth aspect of the invention provides the automatic hair washing device according to any of the first to seventh aspects of the invention, further including a head holding member disposed on the inner face of the inner wall of the cover member.

A ninth aspect of the invention provides the automatic hair washing device according to any of the first to eighth aspects of the invention, further including a neck holding part to hold a human neck and a portion around the human neck.

Effects of the Invention

According to the first aspect of the invention, the cover member is moved along a human head with the human head placed in the head holding space, so that a scalp is scrubbed by the contacts. In addition, since the compressive fluid is accommodated in the accommodation space at an appropriate pressure, the contacts being in contact with the human head apply approximately constant forces to the human head. A contact state of the contacts with the human head is accordingly kept appropriate with ease even when contact positions of the contacts with the human head are displaced by the movement of the cover member.

According to the second aspect of the invention, when the fluid such as a liquid or a gas is supplied into the accommodation space, the pressure of the fluid is applied to each contact. The contacts are thus pushed toward the head holding space. On the other hand, a force which is applied to the leading end of each contact causes each contact to move toward the accommodation space with ease. When the human head is placed in the head holding space, the contacts accordingly come into contact with the human head in a state in which the force applied from the human head to the contacts is balanced with the force applied from the fluid in the accommodation space to the contacts at the respective positions of the human head. When the cover member is moved along the human head in this state, the scalp is scrubbed by the contacts. In addition, the contacts come into contact with the human head in the balanced state at the respective positions even when the contact positions with the human head are displaced by the movement of the cover member.

According to the third aspect of the invention, adjusting the pressure of the fluid to be supplied to each space enables adjustment of the contact state of the contacts with the human head in accordance with the position of the human head.

According to the fourth aspect of the invention, each of the contacts, to which the pressure of the fluid is not applied, protrudes in the head holding space by an appropriate amount.

According to the fifth aspect of the invention, each of the contacts retracts from the head holding space with the pressure of the fluid not applied to the accommodation space.

According to the sixth aspect of the invention, the cover member is moved along the human head with the human head placed in the head holding space, so that the scalp is scrubbed by the contacts. In addition, the spring members are appropriately disposed in the respective contacts. The contacts being in contact with the human head therefore apply approximately fixed forces to the human head. The contact state of the contacts with the human head is thus kept appropriate with ease even when the contact positions of the contacts with the human head are displaced by the movement of the cover member.

According to the seventh aspect of the invention, exchanging the contact portions enables adjustment of the contact state of the contacts with the human head in accordance with positions coming into contact with a human head and the preference of a person whose hair is to be washed.

According to the eighth aspect of the invention, the human head is placed in the head holding space at an appropriate position relative to the inner face of the cover member and the respective contacts.

According to the ninth aspect of the invention, the neck holding part holds the human head in a stable posture to minimize a burden to be put on a person whose hair is to be washed.

MODE FOR CARRYING OUT THE INVENTION

An automatic hair washing device according to the present invention is a device configured to automatically wash human hair and has a feature in that the automatic hair washing device achieves a hair washing operation like hair washing by human hand.

The automatic hair washing device according to the present invention is usable for any person irrespective of a hair length and is configured to wash both the long hair and the short hair.

The automatic hair washing device according to the present invention is also usable in any facility. For example, the automatic hair washing device is usable in typical hair salons and barber shops and is also usable in medical facilities and caregiving homes. The use of the automatic hair washing device in medical facilities and caregiving homes reduces a burden on a person who is dedicated to medical work or caregiving work. In addition, the use of the automatic hair washing device gives an opportunity to frequently wash the hair of a person who needs medical practice or care, which leads to an improvement in quality of life of such a person.

(Automatic Hair Washing Device 1 According to the Present Embodiment)

With reference to the drawings, a description will be given of a structure of an automatic hair washing device 1 according to the present embodiment.

Figure 1:
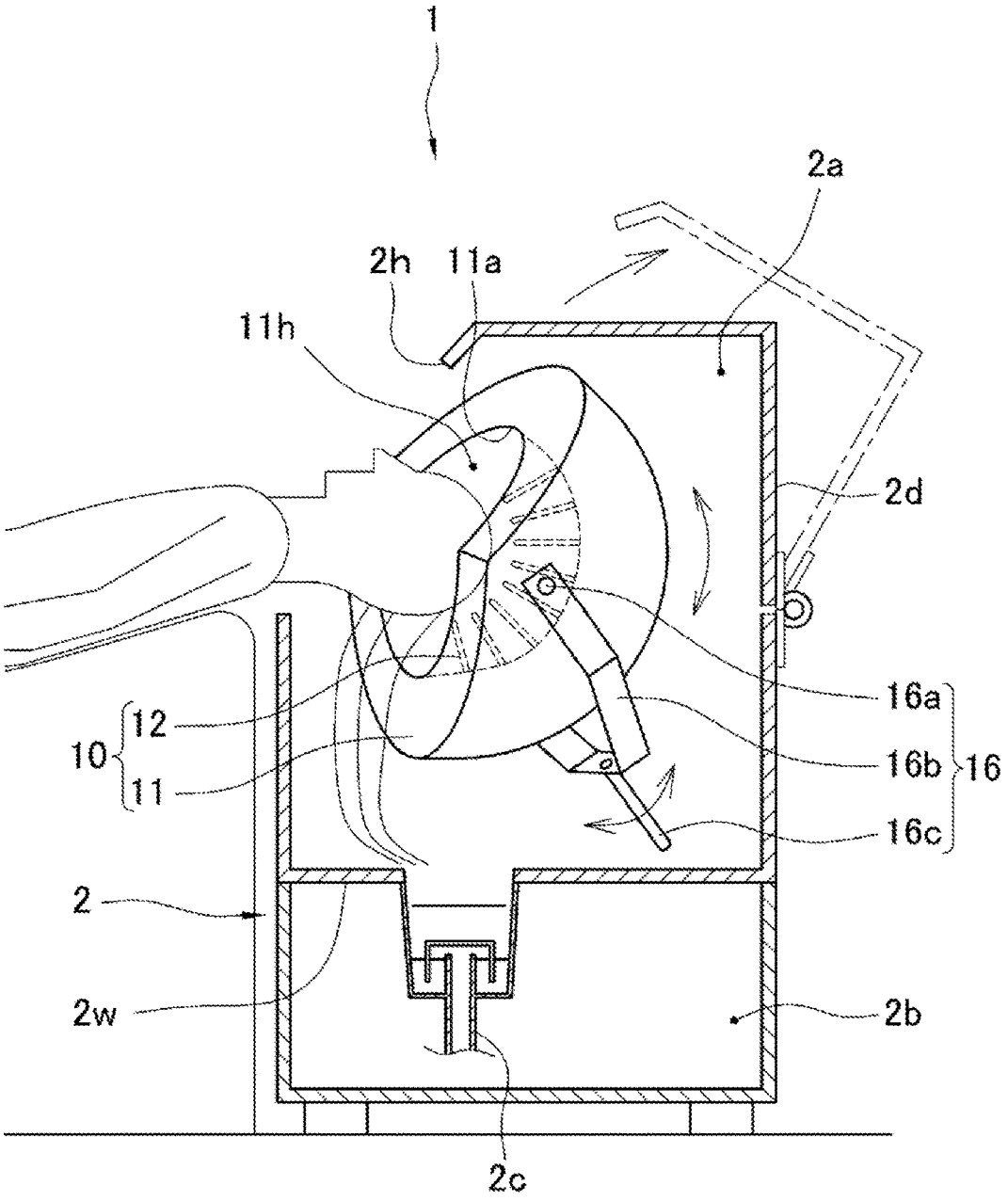
FIG. 1 is a schematic illustration of an automatic hair washing device 1 according to the present embodiment.
Figure 3A:
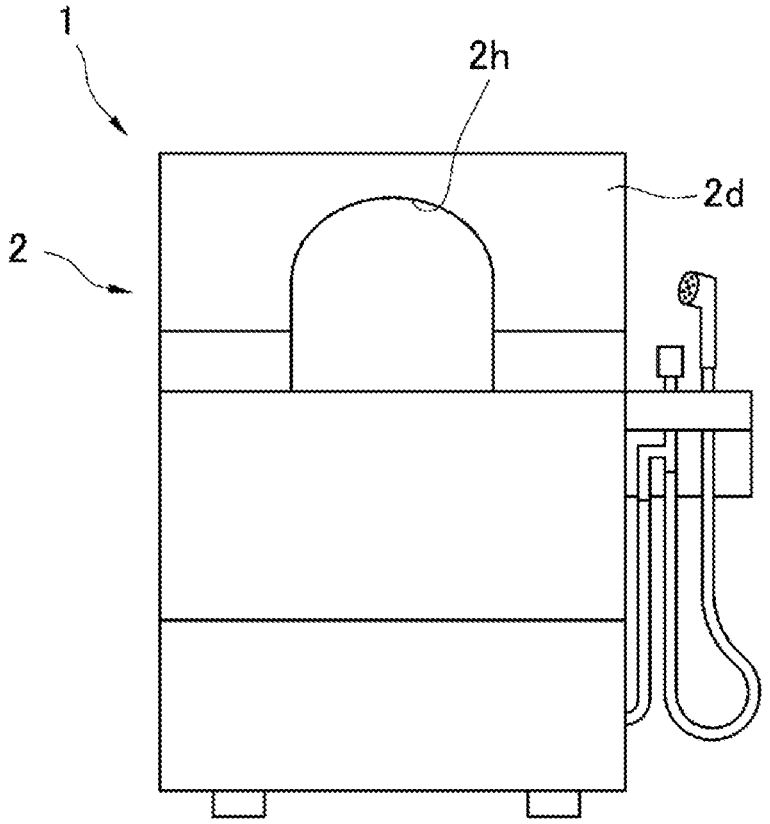
FIGS. 3(A) and 3(B) are respectively a front view and rear view of an appearance of the automatic hair washing device 1 according to the present embodiment.
Figure 3B:
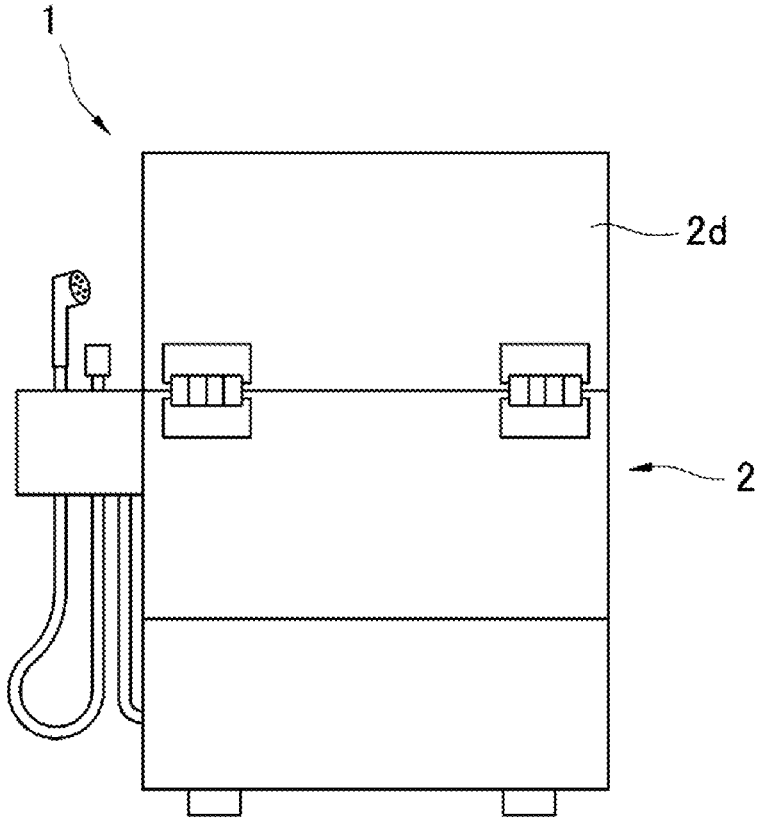
Figure 4A:
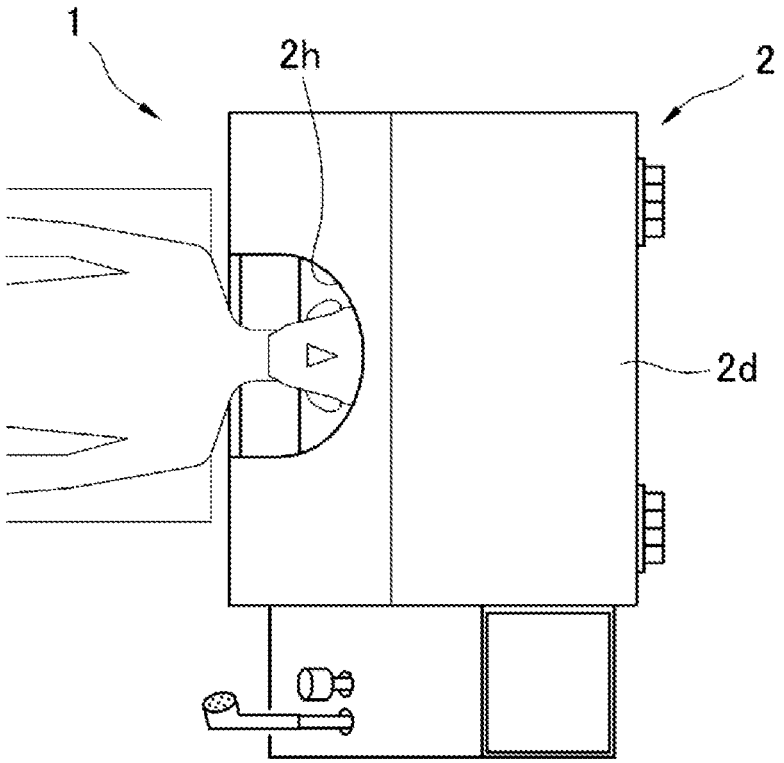
FIGS. 4(A) and 4(B) are respectively a plan view and side view of the appearance of the automatic hair washing device 1 according to the present embodiment.
Figure 4B:
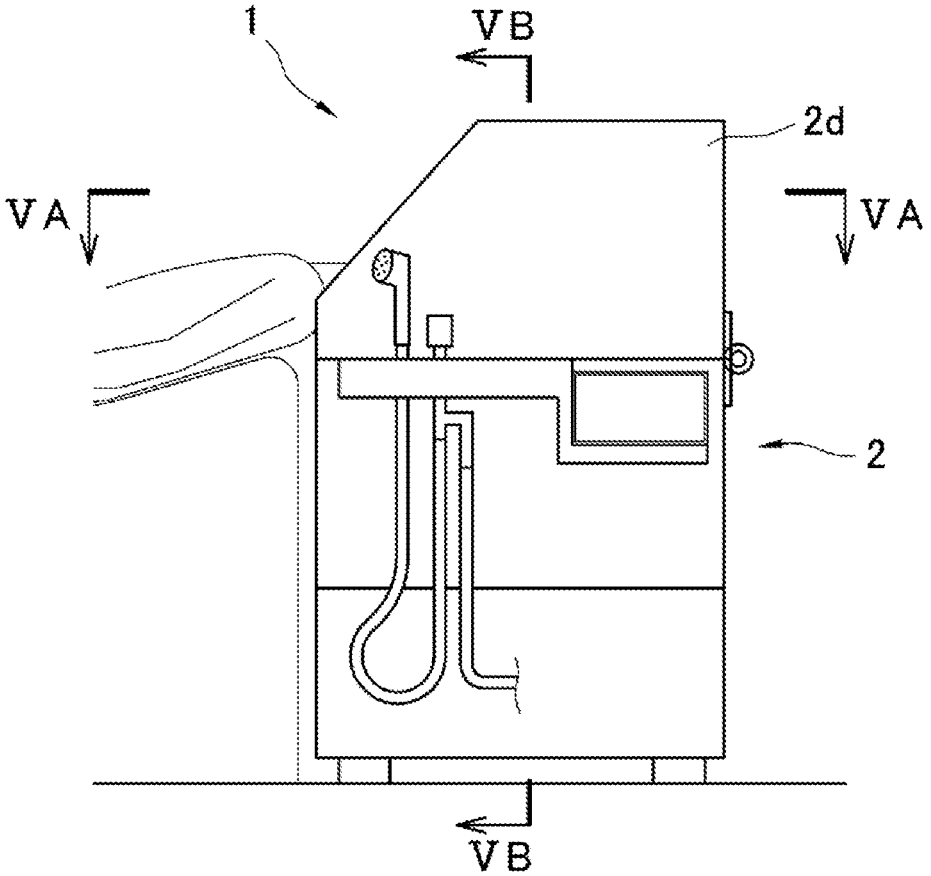

With reference to FIG. 1 as well as FIGS. 3(A)C to 5(B), the automatic hair washing device 1 according to the present embodiment includes a main body casing 2. In the automatic hair washing device 1 according to the present embodiment, the main body casing 2 is divided into a washing space 2*a* where a washing part 10 is disposed, and a drain space 2*b* where a drain pipe 2*c* and the like are disposed. The washing space 2*a* and the drain space 2*b* are separated from each other by a separation wall 2*w* to which one end of the drain pipe 2*c* is connected. The other end of the drain pipe 2*c* is disposed outside the main body casing 2. According to this structure, the drain pipe 2*c* drains, for example, water used in the washing space 2*a* from the automatic hair washing device 1 to the outside.

As illustrated in FIG. 1 as well as FIGS. 3(A) to 5(B), the main body casing 2 has on its upper side an opening 2*h* through which the washing space 2*a* communicates with the outside. The opening 2*h* allows the head of a person whose hair is to be washed, to be placed in the washing space 2*a* and has such a size that the head passes through the opening 2*h*.

As illustrated in FIG. 1 as well as FIGS. 3(A) to 5(B), the main body casing 2 may also have on its upper side a lid member 2*d* that is openable and closable. By opening the lid member 2*d*, the head of a person whose hair is to be washed is easily placed in the washing space 2*a* as compared with a case where the head is placed in the washing space 2*a* through the opening 2*h*. In addition, the lid member 2*d* reduces an opening area of the opening 2*h*, which easily prevents water and a washing liquid from being scattered outside the automatic hair washing device 1 through the opening 2*h*.

(Washing Part 10)

Figure 2:
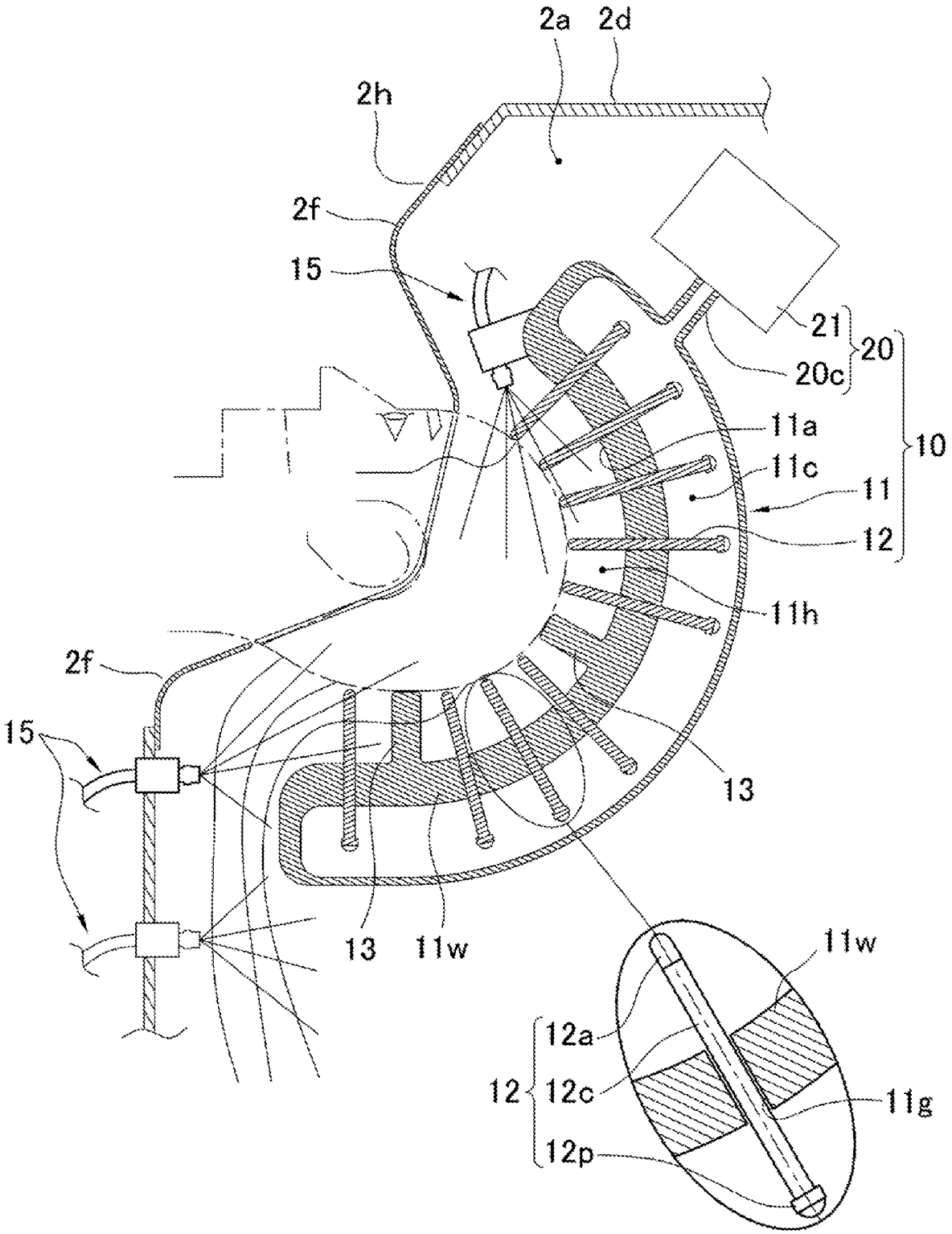
FIG. 2 is a schematic enlarged illustration of a washing part 10 of the automatic hair washing device 1 according to the present embodiment.

As illustrated in FIGS. 1 and 2, the washing part 10 is disposed in the washing space 2*a* of the main body casing 2. The washing part 10 includes a cover member 11, a plurality of contacts 12 disposed on an inner face of the cover member 11, and energization means 20. The washing part 10 also includes washing liquid supply parts 15 to spray water and a washing liquid onto the head and hair of a person whose hair is to be washed, a swing mechanism 16 to move the cover member 11, and a control part to control operations of the washing liquid supply parts 15, swing mechanism 16, and energization means 20.

(Cover Member 11)

The cover member 11 has the inner face 11*a* recessed from the opening 2*h* of the main body casing 2. The cover member 11 also has a head holding space 11*h* corresponding to a portion surrounded with the inner face 11*a* and having such a size that a human head is placeable. It is assumed herein that the inner face 11*a* of the cover member 11 is formed in a substantially semispherical shape. In this case, when the inner face 11*a* is set to have a radius of curvature of approximately 80 to 250 mm, almost all of human heads are placeable in the head holding space 11*h*. Moreover, a clearance is defined between a surface of a human head and the inner face 11*a* of the cover member 11.

As illustrated in FIGS. 1 and 2, the contacts 12 are disposed on the inner face 11*a* of the cover member 11. Each of the contacts 12 is formed of a rod-shaped member whose leading end has a substantially spherical shape and is disposed such that the leading end comes into contact with a human head placed in the head holding space 11*h*. The contacts 12 are mounted to the inner face 11*a* of the cover member 11 in an axially movable manner. The details thereof will be described later.

The energization means 20 is configured to energize the contacts 12 toward the respective leading ends. The energization means 20 has a function of adjusting an energizing force to be applied to the contacts 12 such that the contacts 12 apply approximately constant forces to a human head even when the swing mechanism 16 swings the cover member 11 to displace contact positions of the contacts 12 with the human head as will be described in detail later. Since the energization means 20 energizes the contacts 12 as described above, the leading ends of the contacts 12 come into contact with the human head by the constant forces when the human head is placed in the head holding space 11*h* of the cover member 11. The configuration of the energization means 20 will be described in detail later.

As illustrated in FIG. 2, the washing part 10 includes the washing liquid supply parts 15 each having a function of spraying water and a washing liquid onto the head and hair of a person whose hair is to be washed. Specifically, each of the washing liquid supply parts 15 includes a water nozzle to eject the water and a liquid nozzle to eject a washing liquid. The water ejected from the water nozzle and a washing liquid ejected from the liquid nozzle are thus sprayed onto the head and the hair.

Figure 5A:
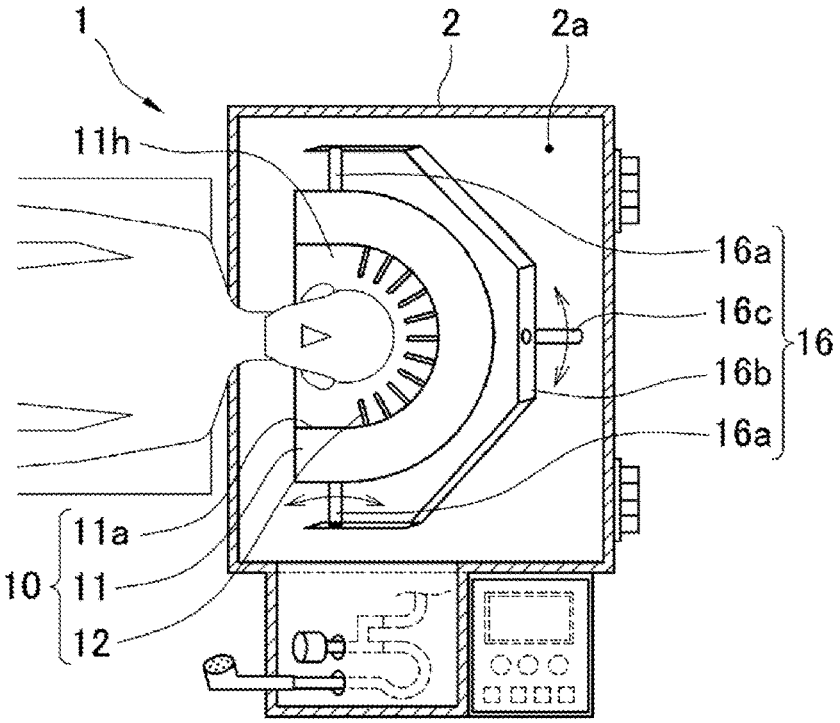
FIGS. 5(A) and 5(B) are schematic illustrations of a usage state of the automatic hair washing device 1 according to the present embodiment.
Figure 5B:
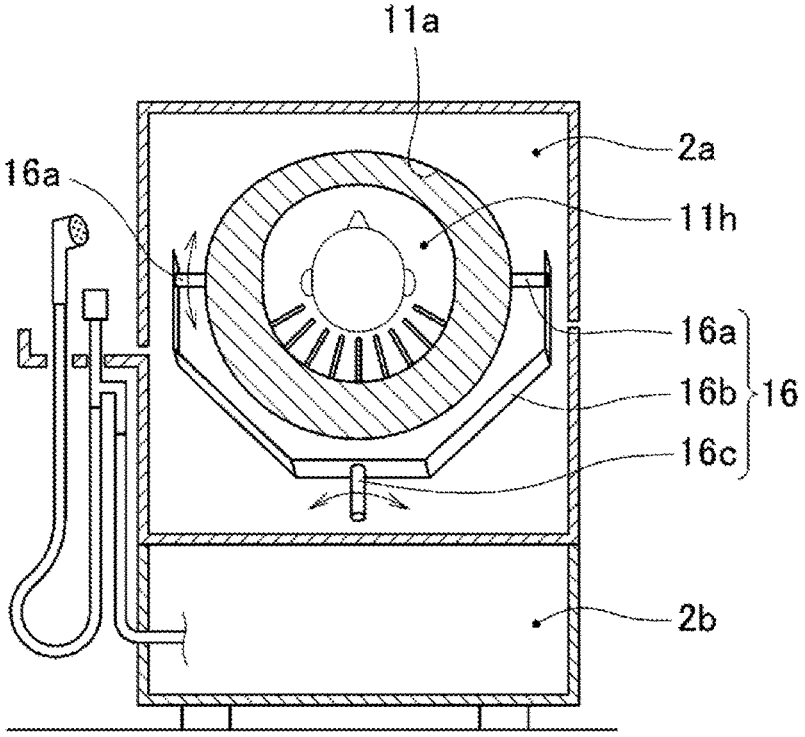

As illustrated in FIGS. 1, 5(A), and 5(B), the washing part 10 also includes the swing mechanism 16 to swing the cover member 11. The swing mechanism 16 includes a pair of swing shafts 16*a*, 16*a* connected to an outer face of the cover member 11. The swing shafts 16*a*, 16*a* are connected to a swing frame 16*b* so as to be rotatable coaxially about their center axes. The swing frame 16*b* is coupled to an inner face of the washing space 2*a* of the main body casing 2 through a swing shaft 16*c*. The swing shaft 16*c* is connected to the inner face of the washing space 2*a* so as to be rotatable about its center axis. In the swing mechanism 16, the pair of swing shafts 16*a*, 16*a* and the swing shaft 16*c* are disposed to swing the cover member 11 in a direction along the inner face 11*a* when both or one of the pair of swing shafts 16*a*, 16*a* and the swing shaft 16*c* rotate or rotates. In other words, the pair of swing shafts 16*a*, 16*a* and the swing shaft 16*c* are disposed to move the cover member 11 in all directions along a human head in the head holding space 11*h*. Specifically, the pair of swing shafts 16*a*, 16*a* and the swing shaft 16*c* are disposed such that the inner face 11*a* of the cover member 11 has a center of curvature at a position where lines of the center axes of the swing shafts 16*a*, 16*a* cross a line of the center axis of the swing shaft 16*c*. The rotation of the pair of swing shafts 16*a*, 16*a* about the center axes and the rotation of the swing shaft 16*c* about the center axis are controlled by, for example, an electric motor or pneumatic cylinder whose operation is controlled by the control part.

The washing part 10 also includes the control part to control the operations of the energization means 20, swing mechanism 16, and washing liquid supply parts 15. The control part has a function of adjusting an energizing force to be applied from the energization means 20 to the contacts 12 such that the contacts 12 of the energization means 20 apply approximately constant forces to a human head.

The control part also has a function of controlling, for example, timings at which the washing liquid supply parts 15 and the swing mechanism 16 operate, in order that the washing part 10 appropriately washes and rinses hair. Specifically, the control part has a function of detecting a state of water flowing through the drain pipe 2*c*, thereby controlling an amount of water and a washing liquid supplied from the washing liquid supply parts 15 and stopping the supply of the water and washing liquid. The control part also has a function of controlling an amount of operation by the swing mechanism 16, that is, an amount of movement of the cover member 11. It is of course that the control part may include a built-in timer to be used for controlling the operations of the washing liquid supply parts 15 and swing mechanism 16.

According to the present embodiment, the automatic hair washing device 1 having the structure described above washes hair while scrubbing a scalp by the contacts 12 and brushing the hair with the contacts 12.

First, the head of a person whose hair is to be washed is put in the washing space 2*a* with the lid member 2*d* opened or through the opening 2*h* in the main body casing 2, and then is placed in the head holding space 11*h* of the cover member 11 in the washing part 10. The head is thus brought into contact with the leading ends of the contacts 12. At this time, the energization means 20 energizes the contacts 12 toward the respective leading ends. The contacts 12 therefore come into contact with the head while receiving a certain degree of force.

In this state, the washing liquid supply parts 15 supply water, and the swing mechanism 16 swings the cover member 11. The contacts 12 then move while scrubbing a scalp. Since each of the contacts 12 is formed of a rod-shaped member, the contacts 12 run through hair like human fingers and a comb. The hair, even when being long, is disentangled by the contacts 12 while being wet.

When the hair is satisfactorily wet, each of the washing liquid supply parts 15 supplies a washing liquid with the swing mechanism 16 operated. The hair is thus washed with the washing liquid. Also at this time, since the contacts 12 run through the hair like human fingers and a comb, both the scalp and the hair are washed while the scalp is scrubbed by the contacts 12 and the hair is brushed with the contacts 12. In washing long hair, it is difficult to wash the long hair entirely only by spraying a detergent onto the long hair and merely rubbing the surface of the long hair. In contrast to this, the automatic hair washing device 1 appropriately and entirely washes long hair since the contacts 12 brush the long hair in washing the long hair.

After the hair washing, each of the washing liquid supply parts 15 supplies water with the swing mechanism 16 operated. The washed hair is thus rinsed. Also at this time, since the contacts 12 run through the hair like human fingers and a comb, the hair is rinsed while being disentangled by the contacts 12. The rinsing is efficiently performed with a smaller amount of water as compared with rinsing to be performed by merely spraying water onto hair. Particularly in washing long hair, this configuration enables effective rinsing. As in the case of hair washing, it is difficult to rinse the entire hair only by spraying water onto the hair and merely rubbing the surface of the hair. In contrast to this, the automatic hair washing device 1 appropriately and entirely rinses the long hair since the contacts 12 brush the long hair in rinsing the long hair.

(Contacts 12 and Energization Means 20)

As described above, in the automatic hair washing device 1 according to the present embodiment, the contacts 12 and energization means 20 are configured as will be described below to make forces to be applied from the contacts 12 to a human head approximately constant. The configurations of the contacts 12 and energization means 20 are described below.

(Energization Means 20)

As illustrated in FIG. 2, the cover member 11 has an accommodation space 11*c* defined therein and formed in a hollow shape. The accommodation space 11*c* has a structure in that a fluid is retainable. More specifically, the cover member 11 has a structure in that a fluid such as air is not leaked to the outside except portions corresponding to through-holes 11*g* to be described later. In addition, the cover member 11 also has a structure in that a pressure in the accommodation space 11*c* is kept at a predetermined level.

The accommodation space 11*c* of the cover member 11 communicates with a fluid pressure adjustment part 21 via a pipe 20*c*. The fluid pressure adjustment part 21 has a function of maintaining the pressure in the accommodation space 11*c* at a fixed level. For example, the fluid pressure adjustment part 21 may be an apparatus including a compressor, an air tank, and the like to supply to the accommodation space 11*c* a compressive fluid such as air adjusted at a certain pressure, and a discharge valve and the like to discharge the fluid from the accommodation space 11*c*. The fluid pressure adjustment part 21 operates based on a command from the control part. The command is obtained by analyzing the pressure in the accommodation space 11*c*. The pressure is detected by, for example, a sensor.

(Contacts 12)

As illustrated in FIG. 2, the cover member 11 includes an inner wall 11*w* formed to separate the accommodation space 11*c* from the head holding space 11*h*. The inner wall 11*w* has a plurality of through-holes 11*g*. The through-holes 11*g* are formed such that center axes thereof are approximately parallel with a normal direction of the inner face 11*a* of the cover member 11 at positions where the through-holes 11*g* are formed.

The contacts 12 are respectively inserted into the through-holes 11*g*.

As illustrated in FIG. 2, each of the contacts 12 includes a shaft portion 12*c*, a contact portion 12*a* disposed on a front end of the shaft portion, and a stopper plate 12*p* disposed on a rear end of the shaft portion 12*c*.

The shaft portions 12*c* are formed of rod-shaped members which are analogous in sectional shape to the through-holes 11*g*. The shaft portions 12*c* are slightly smaller in sectional area than the through-holes 11*g*.

The contact portions 12*a* are configured to come into contact with a human head and each have a leading end formed in a substantially spherical shape.

The stopper plates 12*p* have outer diameters larger than inner diameters of the through-holes 11*g*.

Each stopper plate 12*p* has a rear end face which may be formed in any shape. In other words, each shaft portion 12*c* has a proximal end edge which may be formed in any shape. As illustrated in FIG. 2, for example, the rear end face of each stopper plate 12*p*, that is, the proximal end edge of each shaft portion 12*c* may be formed in a planar shape orthogonal to a center axis of the corresponding shaft portion 12*c* or may be formed in a spherical shape. The spherical shape brings about an advantage that each of the stopper plates 12*p* easily receives a pressure of the fluid even when being brought into contact with an inside face of the cover member 11, that is, even when being bottomed.

The contacts 12 each having the structure described above are respectively inserted into the through-holes 11*g*. The contacts 12 are thus respectively held by the through-holes 11*g* so as to be axially movable.

In addition, the pressure of the fluid in the accommodation space 11*c* is applied to the contacts 12 to energize the contacts 12 such that the contacts 12 protrude from the inner face 11*a* of the cover member 11. At this time, the contacts 12 receive a constant pressure irrespective of their positions. In addition, the contacts 12 protrude by an approximately constant force as long as the shaft portions 12*c* are equal in sectional area to one another.

The force to protrude the contacts 12 is made constant irrespective of an amount of protrusion of each contact 12 as long as the pressure of the fluid in the accommodation space 11*c* is fixed. The reason therefor is as follows. That is, the force to protrude the contacts 12 is determined from the sectional area of each shaft portion 12*c* and the pressure of the fluid, and the sectional area of each shaft portion 12*c* does not change although the amount of protrusion of each contact 12 changes.

The compressive fluid such as air is supplied into the accommodation space 11*c*, and the pressure of the fluid in the accommodation space 11*c* is adjusted appropriately. When a force is applied to the leading end of each contact 12 in this state, the contacts 12 move toward the accommodation space 11*c* with ease. The contacts 12 accordingly come into contact with a human head placed in the head holding space 11*h*, in a state in which the forces applied from the human head are balanced with the force applied from the fluid in the accommodation space 11*c* at the respective positions of the human head.

In this state, the swing mechanism 16 moves the cover member 11. The contact positions of the contacts 12 with the human head are thus displaced. At some of the contact positions, the human head moves away from the inner face 11*a* of the cover member 11. At the other contact positions, the human head moves closer to the inner face 11*a* of the cover member 11. When the human head moves away from the inner face 11*a* of the cover member 11, the pressure of the fluid causes the contacts 12 to protrude so as to follow the movement of the human head. The pressure of the fluid thus maintains the contact state of the contacts 12 with the human head and also keeps constant the forces applied from the contacts 12 to the human head. On the other hand, when the human head moves closer to the inner face 11*a* of the cover member 11, the contacts 12 are pushed into the accommodation space 11*c* so as to follow the movement of the human head. However, the contacts 12 receive the constant fluid pressure and therefore apply the fixed forces to the human head.

Since the energization means 20 and the contacts 12 are configured as described above, the contacts 12 come into contact with the human head in the state in which the forces applied from the human head are always balanced with the force applied from the fluid in the accommodation space 11*c*. In other words, even when the movement of the cover member 11 by the swing mechanism 16 causes displacement of the contact positions of the contacts 12 with the human head, the contact state of the contacts 12 with the head is maintained, and the forces to be applied to the human head are made constant. The contacts 12 thus enable a hair washing operation as in a situation in which, in washing hair by human hand, fingers scrub a scalp while disentangling the hair.

The pressure of the fluid supplied into the accommodation space 11*c* may be set at any value so long as to move the contacts 12 as described above. For example, the pressure in the accommodation space 11*c* may be adjusted by a person whose hair is to be washed. Even when the contacts 12 apply the same force to a head, a sensation to be given by the same force differs for each person. In other words, persons feel strong or weak as to the same force to be applied from the contacts 12 to their heads. The forces to be applied from the contacts 12 to a human head change depending on the pressure of the fluid supplied into the accommodation space 11*c*. Therefore, when the pressure in the accommodation space 11*c* is adjustable by a person whose hair is to be washed, the person whose hair is to be washed undergoes a hair washing operation under his/her most comfortable conditions. For example, the control part is provided with a pressure adjustment knob. An employee or a person whose hair is to be washed manipulates the pressure adjustment knob, thereby adjusting the pressures in the accommodation space 11*c*.

Even when the contacts 12 apply the same force to a head, a sensation to be given by the same force differs even for the same person depending on positions of the head. In other words, the person feels strong or weak as to the same force applied from the contacts 12 to his/her head depending on the positions, to which the force is applied, of the head. In view of this, the accommodation space 11*c* may be divided into a plurality of spaces such that a fluid is supplied to each of the divided spaces. This configuration enables a hair washing operation that makes a person more comfortable since forces to be applied from the contacts 12 to the head are adjustable for each position of the head. For example, the control part is provided with pressure adjustment knobs to adjust pressures in the respective spaces. An employee or a person whose hair is to be washed manipulates the pressure adjustment knobs, thereby adjusting the pressures in the respective spaces.

The contacts 12 are provided to be movable relative to the through-holes 11*g*. In order to exert the functions described above, desirably, the contacts 12 are provided to be smoothly movable relative to the through-holes 11*g*. Also desirably, no fluid or a considerably small amount of fluid is leaked out from the accommodation space 11*c* through clearances between the contacts 12 and the through-holes 11*g*. In order to satisfy the functions, desirably, a seal member is disposed in each through-hole 11*g*. For example, the seal member is made of plastic, is formed in a cylindrical shape, and is disposed on an inner face of each through-hole 11*g*. An outer face of each shaft portion 12*c* is brought into surface contact with an inner face of the seal member with the shaft portion 12*c* of each contact 12 inserted into the corresponding through-hole 11*g*. This configuration thus achieves the functions, that is, slidability and hermeticity.

In the example described above, the contacts 12 are configured to protrude only by the pressure of the fluid in the accommodation space 11*c*. Alternatively, a spring member may be provided to energize each contact 12 toward the head holding space 11*h*. The spring members protrude the contacts 12 toward the head holding space 11*h* by an appropriate amount even when no fluid pressure is applied to the contacts 12. This configuration brings about an advantage that motive power for energization by the fluid is reduced. In this case, the spring members are adjusted such that the forces of the spring members to energize the contacts 12 toward the head holding space 11*h* are weaker than the force of the fluid to energize the contacts 12 toward the head holding space 11*h*. With this configuration, the forces applied from the contacts 12 to the human head are maintained as in the configuration that the spring members are not provided.

In contrast, a spring member may be provided between the stopper plate 12*p* of each contact 12 and the inside face of the cover member 11 to pull the corresponding contact 12 toward the accommodation space 11*c*. The spring members retract the contacts 12 into the accommodation space 11*c* to which the fluid pressure is not applied. This configuration brings about an advantage that it becomes unnecessary to prepare a device to retract the contacts 12 (e.g., a device to generate a negative pressure in the accommodation space 11*c*).

(Contacts 12)

In each of the contacts 12, the contact portion 12*a* to come into contact with a human head may be configured to be detachable. The contact portions 12*a* which are exchangeable bring about an advantage that a contact state of the contacts 12 with a human head is adjustable in accordance with positions coming into contact with a human head and the preference of a person whose hair is to be washed, without exchanging the contacts 12.

For example, the leading end of each contact 12, that is, the contact portion 12*a* is configured to have a smaller curvature. The leading end with a smaller curvature causes a person whose hair is to be washed to feel as a receiving stronger force as compared with the leading end with a larger curvature even when the energization means 20 applies the same energizing force to the respective contacts 12. In contrast, the leading end of each contact 12, that is, the contact portion 12*a* is configured to have a larger curvature. The leading end with a larger curvature causes a person whose hair is to be washed to feel as receiving a weaker force as compared with the leading end with a smaller curvature even when the energization means 20 applies the same energizing force to the respective contacts 12. Accordingly, the contacts 12 change a sensation on the head of a person depending on contact positions with the head even when the energization means 20 applies the same energizing force to the contacts 12.

Any number of contacts 12 may be disposed on the inner face 11*a* of the cover member 11. For example, the number of contacts 12 may be about 18 to 200 in total such that about 18 to 200 contacts are brought into contact with the head of a person whose hair is to be washed.

The contacts 12 may be disposed at any positions on the inner face 11*a* of the cover member 11 at the same intervals, that is, in certain density. The number of contacts 12 may be changed in accordance with positions coming into contact with a scalp.

(Swing Mechanism 16)

The cover member 11 may be swung by any configuration in addition to the configuration described above as long as the inner face 11*a* of the cover member 11 is movable along a scalp.

(Cover Member 11)

The inner face 11*a* of the cover member 11 may be formed in any shape in addition to the substantially semispherical shape as long as a human head is placeable in the head holding space 11*h*. For example, the inner face 11*a* of the cover member 11 may be formed in an elliptical shape or an oblong shape as seen in sectional view.

As used herein, the phrase "a human head is placed in the head holding space 11*h*" does not mean that a human head is entirely placed, but means that a human head excluding a face portion is entirely or partly placed as illustrated in FIGS. 1 and 2. For example, the phrase "a human head is placed in the head holding space 11*h*" used herein refers to a case where a range from a forehead and its vicinity to the nape and its vicinity of a neck is placed or a case where a range from the top to back of a head is almost entirely placed.

(Head Holding Members 13)

In the head holding space 11*h* of the cover member 11, a position of a human head relative to the inner face 11*a* changes in accordance with a posture of a person whose head is put in the washing space 2*a* and a position of the head in the washing space 2*a*. In other words, a contact state of the contacts 12 with a human head changes. Even when the contact state changes, the energization means 20 adjusts an energizing force to energize the contacts 12 such that the contacts 12 apply approximately constant forces to the human head as described above. In an initial state, however, if the human head is put in a considerably deviated posture in the head holding space 11*h* of the cover member 11 or if the human head is put in the head holding space 11*h* deeper than expected, an amount of movement of each contact 12 cannot be secured satisfactorily. As a result, when the cover member 11 is swung, the contacts 12 cannot apply approximately constant forces to the human head.

The automatic hair washing device 1 according to the present embodiment is therefore desirably provided with head holding members 13 to place a human head at a position where the functions described above are exerted with reliability in the head holding space 11*h* of the cover member 11.

As illustrated in FIG. 2, for example, each of the head holding members 13 is formed of a bar-shaped or block-shaped member and is disposed on the inner face 11*a* of the cover member 11. The head holding members 13 thus place a human head in the head holding space 11*h* at an appropriate position from the inner face 11*a* of the cover member 11. In other words, when the human head is rested on leading end faces of the head holding members 13, the human head is held while being separated by a length of each head holding member 13, that is, a length from the faces with which the human head is in contact to the inner face 11*a*. The head holding members 13 thus secure a satisfactory amount of movement of each contact 12 and therefore cause the contacts 12 to apply approximately constant forces to the human head when the cover member 11 is swung.

The number of head holding members 13 is not particularly limited, but may be three or more, only one, or only two. The number of head holding members 13 is desirably three such that a human head is rested in a stable posture.

The head holding members 13 may be fixed to the inner face 11*a* of the cover member 11 or may be provided to extend from the inner face 11*a* of the cover member 11.

Each of the head holding members 13 may have any configuration in addition to the configurations described above as long as a human head is placeable at an appropriate position relative to the inner face 11*a* of the cover member 11 and the respective contacts 12. For example, each of the head holding members 13 may be formed of a bar-shaped or block-shaped member and may be disposed on the member in which the opening 2*h* is formed, that is, on the main body casing 2.

(Configuration of Main Body Casing 2)

As illustrated in FIG. 1, the drain pipe 2*c* is disposed in the drain space 2*b*; however, the drain pipe 2*c* is not necessarily disposed in the drain space 2*b*. For example, when one end of the drain pipe 2*c* is connected to a lower side face of the washing space 2*a*, the other end of the drain pipe 2*c* is disposed outside the main body casing 2 without passing the drain space 2*b*.

The opening 2*h* in the main body casing 2 may be formed in any size as long as a human head is insertable into the head holding space 11*h* therethrough. The opening 2*h* preferably has a size allowing a human head to pass therethrough and preventing water and a washing liquid used by the washing part 10 from scattered outside the automatic hair washing device 1 to some extent.

As illustrated in FIG. 2, the automatic hair washing device 1 according to the present embodiment may be provided with, for example, a hood 2*f* to cover the opening 2*h* of the main body casing 2 in terms of the purpose of preventing water and a washing liquid from scattered outside the automatic hair washing device 1 through the opening 2*h* in the main body casing 2.

More preferably, the size of the opening 2*h* is changeable in accordance with the head size and physique of a person whose hair is to be washed. For example, an attachment (e.g., the hood 2*f*) detachable from the opening 2*h* enables changes in width and length of the opening 2*h* in accordance with, for example, the head size of a person whose hair is to be washed.

(Neck Holding Part)

The automatic hair washing device 1 according to the present embodiment may also be provided with a neck holding part to be disposed in the opening 2*h* or in the vicinity (including both inside and outside the washing space 2*a*) of the opening 2*h* to hold the neck and its vicinity of a person whose hair is to be washed. For example, a cushion may be disposed on a lower end portion of the opening 2*h* so that the neck of the person is rest on the cushion during a hair washing operation. The neck holding part keeps the head of the person in a stable posture, which facilitates the hair washing operation using the washing part 10. In addition, the neck holding part makes the person have no tension on his/her neck and therefore reduces a burden on the person during the hair washing operation.

(Washing Liquid Supply Parts 15)

Each of the washing liquid supply parts 15 may have any configuration as long as a water nozzle and a liquid nozzle respectively eject and spray water and a washing liquid onto the head and hair of a person. For example, each of the washing liquid supply parts 15 may be configured as follows.

A water nozzle and a liquid nozzle are respectively connected to a water supply and a washing liquid supply via a water feed tube and a liquid feed tube. The supply of water and a washing liquid from the water supply and the washing liquid supply and the stop of the supply are controllable based on signals from the control part. The commands from the control part cause the water supply and the washing liquid supply to respectively supply water and a washing liquid to the water nozzle and the liquid nozzle. The water nozzle and the liquid nozzle in each washing liquid supply part 15 thus respectively supply the water and the washing liquid to the head and hair of a person.

The water supply and the washing liquid supply may have any configuration as long as the supply of water and a washing liquid and the stop of the supply are controllable based on signals from the control part. For example, each of the water supply and the washing liquid supply may include a valve opened and closed based on signals from the control part, and a liquid feed part to supply pressurized water and a pressurized washing liquid in accordance with signals from the control part. Specifically, the water supply may be configured to include, as the liquid feed part, a supply pipe communicating with a water pipe, and a valve disposed on the liquid feed part. In supplying a washing liquid, the washing liquid supply may be configured to include, as the liquid feed part, a supply pipe communicating with a pipe of an external washing liquid supply device, and a valve disposed on the liquid feed part and connected to a liquid feed tube.

The water nozzle and the liquid nozzle may be placed at any location so long as to spray water and a washing liquid onto the head and hair of a person. For example, the washing liquid supply parts 15 are disposed on an end of the cover member 11 as illustrated in FIG. 2, thereby supplying appropriate amounts of water and a washing liquid to the hair with ease. For a person with long hair, the washing liquid supply parts 15 are disposed in the inner face of the washing space 2*a*, thereby supplying appropriate amounts of water and a washing liquid to the long hair with ease.

(Another Washing Part 30)

Figure 6:
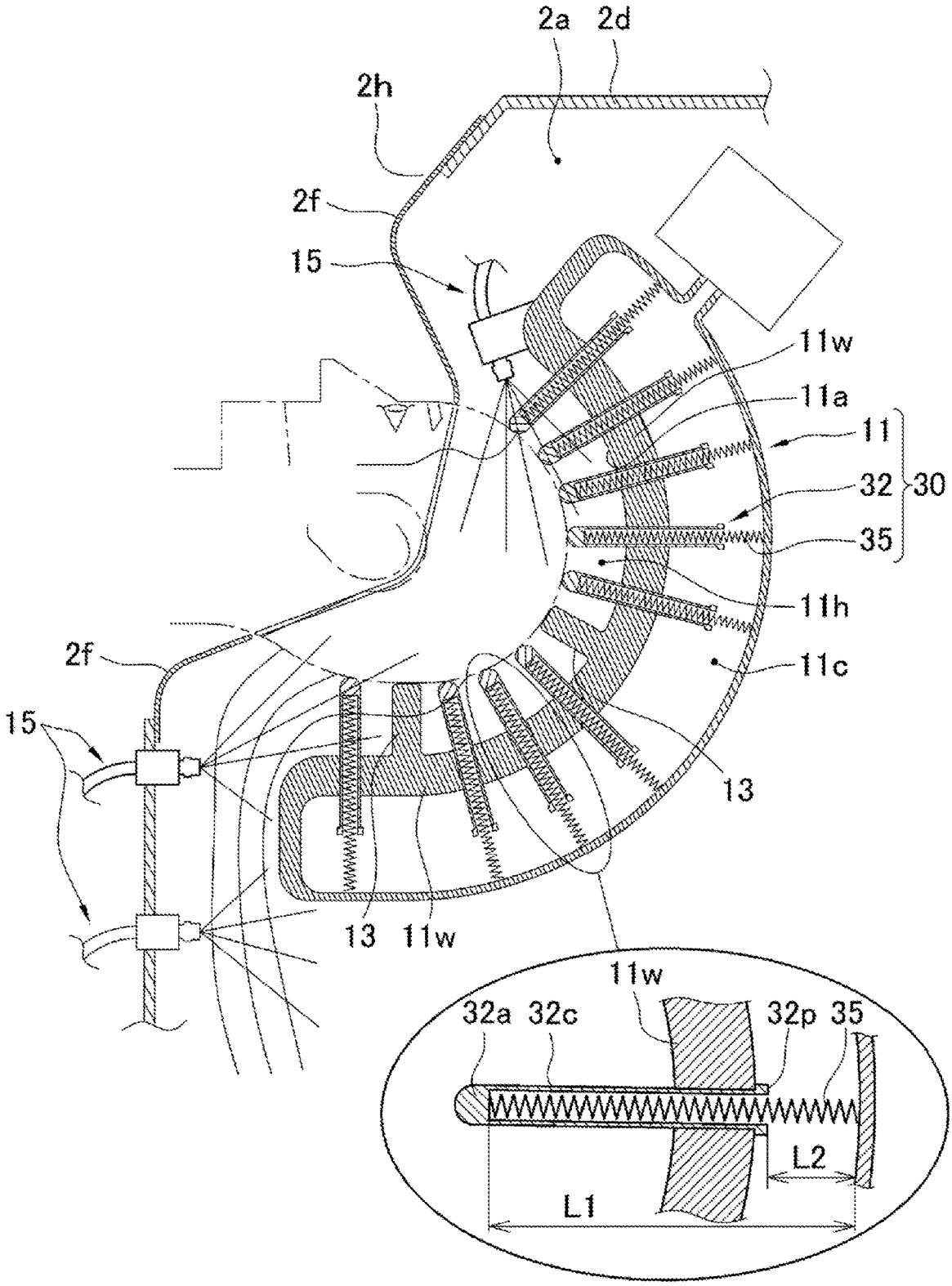
FIG. 6 is a schematic enlarged illustration of a washing part 30 according to another embodiment.

In the foregoing embodiment, the washing part 10 includes the energization means to energize the contacts 12 toward the head holding space 11*h* by use of a fluid pressure. As illustrated in FIG. 6, alternatively, the energization means may be springs 35 to energize contacts 32 toward a head holding space 11*h*.

FIG. 6 illustrates a configuration in which the springs 35 respectively apply energizing forces to the contacts 32. A cover member 11 illustrated in FIG. 6 is substantially equal in configuration to the cover member 11 described above; therefore, the description thereof will not be given here.

Each of the contacts 32 illustrated in FIG. 6 is formed of a one end-closed tubular member of which a leading end is closed and which is formed in a hollow shape. The springs 35 are respectively disposed in the contacts 32. The springs 35 are disposed to contract coaxially or approximately coaxially with axes of the contacts 32. Each of the springs 35 has a proximal end protruding from a proximal end of the corresponding contact 32. The proximal ends of the springs 35 are fixed to an inside face of an accommodation space 11*c* of the cover member 11, that is, an inside face opposing an inner wall 11*w* of the cover member 11.

The springs 35 are adjusted to apply energizing forces that do not almost change while a human head pushes the contacts 32 inward. More specifically, the springs 35 are adjusted such that forces to be applied from the contacts 32 to the human head do not almost change even when contact positions of the contacts 32 with the human head are displaced by movement of the cover member 11. As in the case of energizing the contacts by use of a fluid pressure, thus, the contacts 32 are brought into contact with the human head in the balanced state at the respective positions even when the contact positions with the human head are displaced by the movement of the cover member 11.

In FIG. 6, L1 represents a length of each spring 35 mounted to the inside face of the accommodation space 11*c*, and L2 represents a maximum stroke of each contact 32. The springs 35 are mounted such that a force to be applied to the human head when each spring 35 contracts by an amount corresponding to the maximum stroke L2, that is, when each contact 32 protrudes in a minimum amount (i.e., an energizing force to be applied from each spring 35 to the corresponding contact 32) is approximately equal to a force to be applied to the human head in the state in which each spring 35 has the length L1. As a result, the energizing force does not almost change irrespective of the change in stroke of each contact 32. The contacts 32 are therefore brought into contact with the human head in the balanced state at the respective positions even when the contact positions with the human head are displaced by the movement of the cover member 11.

INDUSTRIAL APPLICABILITY

An automatic hair washing device according to the present invention is applicable to a device to be used for washing the hair of a customer in a hair salon or a barber shop and a device to be used for washing the hair of a person who needs care in a caregiving home or a medical facility.

DESCRIPTION OF REFERENCE SIGNS

1: automatic hair washing device
10: washing part
11: cover member
11*a*: inner face
11*h*: head holding space
12: contact
13: head holding member
20: energization means
32: contact
35: spring

The invention claimed is:

1. An automatic hair washing device comprising:
a washing part including
a cover member having a head holding space where a human head is placed;
a plurality of contacts each of which is formed of a rod-shaped member, which has a longitudinal shape extending in an axis direction, and each disposed on an inner face of the cover member in an axially movable manner; and
energization means for energizing the contacts to move toward the head holding space, wherein
the energization means includes:
an accommodation space where a fluid is accommodated, the accommodation space being formed in a hollow shape and separated from the head holding space by an inner wall of the cover member wherein the inner wall has a plurality of penetration holes into each of which one of the contacts is disposed and penetrating; and
a fluid pressure adjustment part to adjust a pressure of the fluid accommodated in the accommodation space at a predetermined level, and
the fluid pressure adjustment part is configured to adjust the pressure of the fluid accommodated in the accommodation space at a pressure to energize the contacts toward the head holding space such that the contacts being in contact with the human head apply approximately constant forces to the human head even when the contacts are moved by the human head.

2. The automatic hair washing device according to claim 1, wherein
the penetration holes are formed orthogonal to the inner face of the inner wall of the cover member.

3. An automatic hair washing device comprising:
a washing part including
a cover member having a head holding space where a human head is placed;
a plurality of contacts each of which is formed of a rod-shaped member, which has a longitudinal shape extending in an axis direction, and each disposed on an inner face of the cover member in an axially movable manner; and energization means for energizing the contacts to move toward the head holding space, wherein the energization means includes:

an accommodation space where a fluid is accommodated, the accommodation space being formed in a hollow shape and separated from the bead holding space by an inner wall of the cover member wherein the inner wall has a plurality of penetration holes into each of which one of the contacts is disposed and penetrating; and a fluid pressure adjustment part to adjust a pressure of the fluid accommodated in the accommodation space at a predetermined level, the fluid pressure adjustment part is configured to adjust the pressure of the fluid accommodated in the accommodation space at a pressure to energize the contacts toward the head holding space such that the contacts being in contact with the human head apply approximately constant forces to the human head even when the contacts are moved by the human head, the accommodation space is divided into a plurality of sub spaces that including a first sub space and a second sub space that are adjacent each other wherein the first sub space accommodates a first fluid, the second sub space accommodates a second fluid, and the first and second fluid are energized by the energization means, and the fluid pressure adjustment part is configured to adjust pressures of the first and second fluids such that the pressure of the first fluid is equal to the pressure of the second fluid even when the contacts in the first and second sub spaces are moved.

4. An automatic hair washing device comprising:

a washing part including a cover member having a head holding space where a human head is placed;

a plurality of contacts each of which is formed of a rod-shaped member, which has a longitudinal shape extending in an axis direction, and each disposed on an inner face of the cover member in an axially movable manner; and energization means for energizing the contacts to move toward the head holding space, wherein the energization means includes:

an accommodation space where a fluid is accommodated, the accommodation space being formed in a hollow shape and separated from the head holding space by an inner wall of the cover member wherein the inner wall has a plurality of penetration holes into each of which one of the contacts is disposed and penetrating; and a fluid pressure adjustment part to adjust a pressure of the fluid accommodated in the accommodation space at a predetermined level, the fluid pressure adjustment part is configured to adjust the pressure of the fluid accommodated in the accommodation space at a pressure to energize the contacts toward the head holding space such that the contacts being in contact with the human head apply approximately Constant forces to the human head even when the contacts are moved by the human head, the accommodation space is divided into a plurality of sub spaces that including a first sub space and a second sub space that are adjacent each other wherein the first sub space accommodates a first fluid, the second sub space accommodates a second fluid, and the first and second fluid are energized by the energization means, and the fluid pressure adjustment part is configured to adjust pressures of the first and second fluids such that the pressure of the first fluid is different from the pressure of the second fluid.

5. The automatic hair washing device according to claim 1, further comprising a plurality of spring members to energize the contacts toward the head holding space, each of the spring members is arranged to correspond one of the contacts wherein the corresponding one of the contacts is defined as a corresponding contact with respect to the spring member, each of the spring members is configured to provide an energizing force, which is conveyed to the corresponding contact, adjusted to be weaker than the constant force that is generated by the fluid supplied into the accommodation space and conveyed to the corresponding contact.

6. The automatic hair washing device according to claim 1, further comprising a plurality of spring members that are configured to pull the contacts toward the accommodation space, each of the spring members is arranged to correspond one of the contacts wherein the corresponding one of the contacts is defined as a corresponding contact with respect to the spring member, each of the spring members is configured to provide an energizing force, which is conveyed to the corresponding contact, adjusted to be weaker than the constant force that is generated by the fluid supplied into the accommodation space and conveyed to the corresponding contact.

7. An automatic hair washing device comprising a washing part including:

a cover member having a head holding space where a human head is placed;

a plurality of contacts each of which is formed of a rod-shaped member, which has a longitudinal shape extending in an axis direction, and each disposed on an inner face of the cover member in an axially movable manner; and energization means for energizing the contacts to move toward the head holding space, wherein each of the contacts is formed of a one end-closed tubular member having a closed end with which the human head is in contact, the one end-closed tubular member being formed in a hollow shape and disposed such that an axis thereof extends orthogonal to the inner face of the cover member, the energization means includes an inner wall inside the head holding space wherein the inner wall has a plurality of penetration holes into each of which one of the contacts is disposed and penetrating, and a plurality of spring members each of which is disposed inside one of the contacts wherein the one of the contacts is defined as a corresponding contact, and each of the spring members contacts to the corresponding contact to energize toward the head holding space, and the spring members are adjusted such that an energizing force to be applied to the corresponding contact when the corresponding contact protrudes in a minimum amount becomes approximately equal to an energizing force to be applied to the corresponding contact when the contact protrudes in a maximum amount.

8. The automatic hair washing device according to claim 1, wherein each of the contacts includes a contact portion at its distal end with which the human head is in contact, the contact portion being configured to be detachable.

9. The automatic hair washing device according to claim 1, further comprising a head holding member disposed on the inner face of the inner wall of the cover member.

10. The automatic hair washing device according to claim 1, further comprising a neck holding part to hold a human neck and a portion around the human neck.

11. The automatic hair washing device according to claim 7, wherein each of the contacts includes a contact portion at its distal end with which the human head is in contact, the contact portion being configured to be detachable.

12. The automatic hair washing device according to claim 7, further comprising a head holding member disposed on the inner face of the inner wall of the cover member.

13. The automatic hair washing device according to claim 7, further comprising a neck holding part to hold a human neck and a portion around the human neck.

14. The automatic hair washing device according to claim 1, further comprising each of the contacts includes a contact portion at its distal end with which the human head is in contact, the contacts are grouped into several groups that include a first group and a second group, the contact portion in the first group has a first curvature, the contact portion in the second group has a second curvature, and the second curvature is different from the first curvature.

15. The automatic hair washing device according to claim 7, further comprising each of the contacts includes a contact portion at its distal end with which the human head is in contact, the contacts are grouped into several groups that include a first group and a second group, the contact portion in the first group has a first curvature, the contact portion in the second group has a second curvature, and the second curvature is different from the first curvature.

* * * * *